United States Patent [19]

Sandoval

[11] 4,245,473

[45] Jan. 20, 1981

[54] FLUID MOTOR

[76] Inventor: Dante J. Sandoval, 6412 Pear Ave., Cleveland, Ohio 44102

[21] Appl. No.: 826,734

[22] Filed: Aug. 22, 1977

[51] Int. Cl.[3] ..... F03C 5/00

[52] U.S. Cl. ..... 60/496; 415/7; 415/92

[58] Field of Search ..... 60/496, 495, 500, 501, 60/505, 506; 417/329, 61; 415/92, 141, 212 R, DIG. 2, 7; 416/6, 24, 84, 90 R, 90 A, 91, 119, 197 A

[56] References Cited

U.S. PATENT DOCUMENTS

| | | | |
|---|---|---|---|
| 73,400 | 1/1868 | Snodgrass | 415/141 |
| 1,109,804 | 9/1914 | Wagley | 415/92 |
| 1,649,644 | 11/1927 | Alexeeff | 415/141 |
| 2,135,110 | 11/1938 | Platt | 60/496 |
| 3,360,926 | 1/1968 | Parr | 60/496 |
| 3,860,355 | 1/1975 | Dell | 415/7 |

FOREIGN PATENT DOCUMENTS

| | | | |
|---|---|---|---|
| 77646 | 6/1949 | Czechoslovakia | 60/496 |
| 9802 | of 1899 | United Kingdom | 60/496 |

*Primary Examiner*—Louis J. Casaregola
*Attorney, Agent, or Firm*—Watts, Hoffmann, Fisher & Heinke Co.

[57] ABSTRACT

A fluid motor is disclosed which includes a rotor supported for rotation about a generally horizontal axis by a hollow shaft. The rotor defines a plurality of chambers circumferentially spaced apart relative to the axis. A relatively large area flow passage extends from the trailing wall portion of each chamber to a succeeding chamber to enable fluid flow between said chambers in a direction opposite to the direction of rotation of the rotor. A relatively dense working fluid partially occupies the rotor. Intake valving introduces a motive fluid into the rotor chambers disposed within a predetermined angular range relative to the axis so that the motive fluid displaces the working fluid from those chambers through associated respective flow passages and in so doing drives the rotor. Exhaust valving communicates with successive rotor chambers disposed in a second angular range relative to the axis for enabling motive fluid to exhaust from the chambers.

18 Claims, 7 Drawing Figures

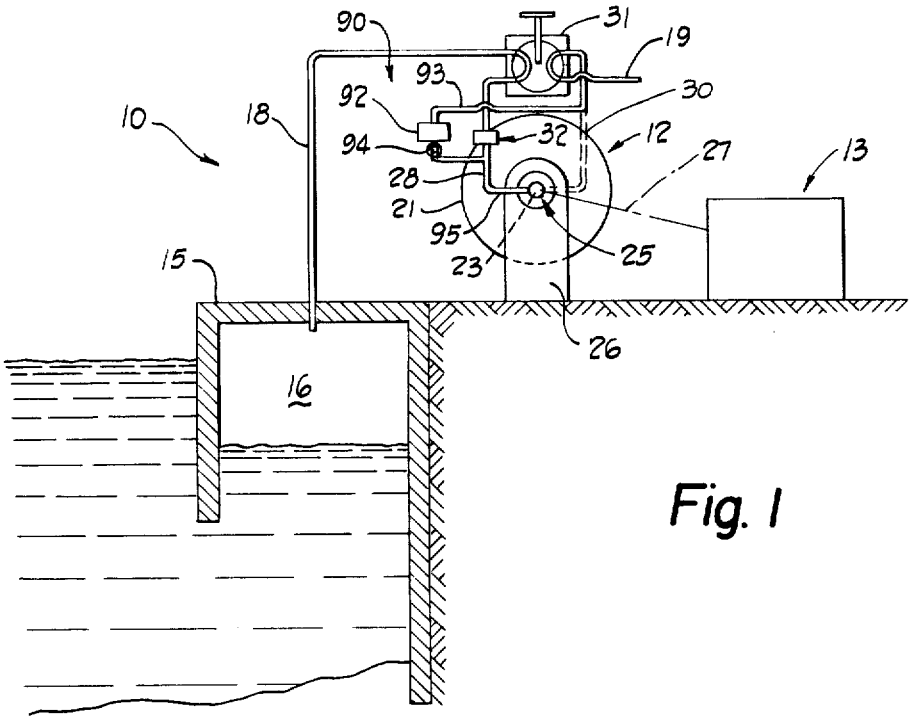
Fig. 1
Fig. 2
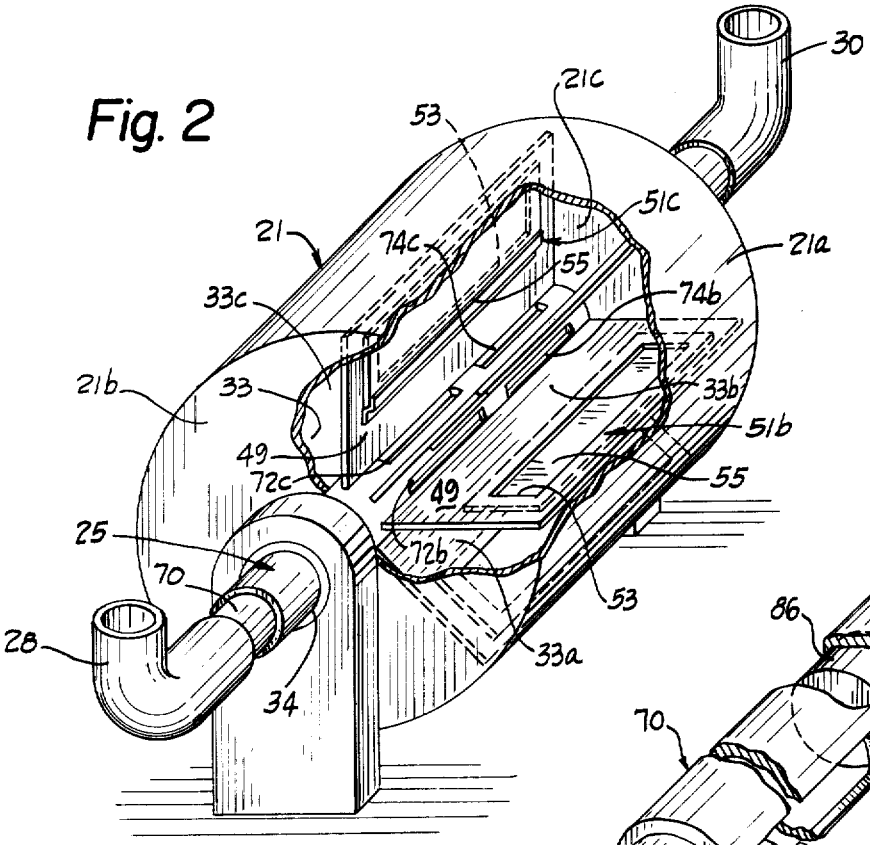
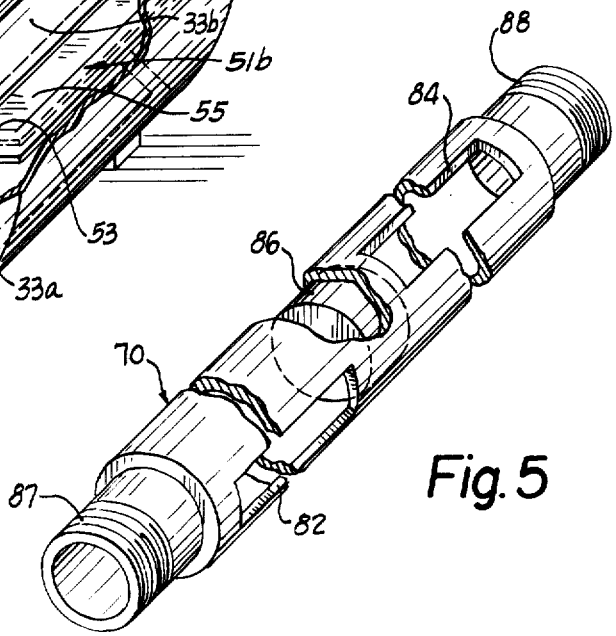
Fig. 5

FLUID MOTOR

BACKGROUND OF THE INVENTION

1. Field of the Invention

The present invention relates generally to apparatus for facilitating recovery of mechanical energy from fluids and more particularly to apparatus for recovering energy from low pressure gases available from industrial or natural sources.

2. Description of the Prior Art

Devices such as the water wheel are known which facilitate the conversion of potential or kinetic energy of fluids into useful work. Variations of the water wheel have been proposed which extract energy from gases. This kind of apparatus generally comprises a vaned wheel which is at least partly submerged in a body of a liquid. A supply of gas is introduced at the bottom of the wheel displacing liquid from the compartments defined by the wheel's vanes. The displacement of liquid from these lower compartments by the gas produces unbalanced buoyant forces which impart torque and consequent rotation to the wheel. (See for example, U.S. Pat. Nos. 6,995; 271,040; and 2,135,110.)

Another device which employs buoyancy forces to recover mechanical energy from a gas comprises fillable bladders serially disposed on a continuous member for movement about a vertically disposed track-like path through a liquid. The bladders are sequentially filled with gas to become buoyant near the lowermost level of their travel and, at the uppermost level of their travel, the bladders are sequentially collapsed for the return downward travel through the liquid. The cumulative buoyancy force of the gas filled bladders imparts motion to the bladder supporting member. (See, for example, U.S. Pat. No. 3,907,454.)

In the past, because of low cost energy sources, industrial plants and processes have frequently exhausted low pressure process gases without attempting to utilize the energy available from the gases. In many cases the cost of equipment which would be necessary to extract the energy has not been justified because of the low initial fuel costs. As fuel costs have risen, the desirability of using the energy of low pressure gases has increased. In addition to gases available in industrial environments, natural sources of low pressure gas flows are or can be made available in many localities. Water-wheel type devices of the sort proposed by the prior art do not, in many instances, provide practical or effective ways to extract energy from these low pressure gas sources.

Summary Of The Invention

The present invention provides a new and improved fluid operated motor which is of simple construction and particularly well adapted for efficiently extracting energy from low pressure gases of the character available from industrial processes or natural sources.

In its preferred form a motor embodying the invention comprises a rotor forming a working volume defined by a plurality of communicable chambers spaced circumferentially about and radially from the rotor axis. A relatively dense working fluid is disposed in chambers defining part of the working volume. Motive fluid, in the form of a low density low pressure fluid, is introduced into the volume to displace the working fluid from chamber to chamber and in so doing reacts between the rotor and the working fluid to create rotor driving torque. The rotor is thus driven to provide mechanical energy.

The rotor is preferably a cylindrical drum-like structure having a peripheral wall and axial end walls and supported by a central horizontal output shaft. Vane-like chamber walls extend axially between the end walls and radially from the shaft to the peripheral wall to define the chambers. According to an important feature of the invention valve assemblies are supported by the chamber walls to enable fluid flow in one direction between successive chambers so that the motive fluid displaces the working fluid from successive chambers as the rotor rotates.

The preferred valve assemblies are formed by relatively large area valve openings in the chamber walls and conforming valving members supported by their respective chamber walls for movement between opened and closed positions. When a given valve assembly is opened it enables relatively unrestricted flow of working fluid from one chamber to the next. When closed, each valve assures that motive fluid introduced into the chamber behind the closed valve displaces the working fluid from that chamber through the next succeeding valve.

The valving members are preferably biased toward their closed positions at least at the rotor position in which the motive fluid is introduced behind the associated chamber wall so that the intake motive fluid is not vented from the chamber.

According to another important feature of the invention intake and exhaust valving for the motive fluid is associated with the supporting shaft so that the rotor need not be provided with sealing interfaces along its axial ends or its periphery. The supporting shaft is cylindrically tubular and defines a pair of valve openings in each rotor chamber which are axially spaced apart and radially aligned. One opening of the pair introduces motive fluid to the chamber while the other opening exhausts the fluid. A tubular valve member is disposed within the shaft and supported against rotation with the shaft. The valve member defines axially spaced radially offset ports which are respectively alignable with intake and exhaust openings in separate rotor chambers. The tubular valve member has a central wall disposed between its intake and exhaust ports and the opposite ends of the valve member communicate intake and exhaust motive fluid to and from the motor. The valve member periphery has a close sliding fit with the internal wall of the shaft so that the motive fluid does not flow directly between the intake and exhaust ports.

Motors embodying the invention can be made quite large in order to maximize energy recovery from low pressure high flow rate gases. In such motors the rotor is disposed in a body of liquid which buoys the rotor and relieves rotor shaft stresses which would otherwise be created by the weight of the rotor and the working fluid.

Other features and advantages of the invention will become apparent from the following description of a preferred embodiment made with reference to the accompanying drawings which form a part of the specification.

BRIEF DESCRIPTION OF THE DRAWINGS

FIG. 1 is a schematic view of a power generation system embodying the invention;

FIG. 2 is a perspective view of a fluid motor embodying the invention with portions shown in cross section;

FIG. 5 is a perspective view of part of an intake and exhaust valve structure of the fluid motor, with portions illustrated in cross section;

DESCRIPTION OF PREFERRED EMBODIMENTS

Figure 3:
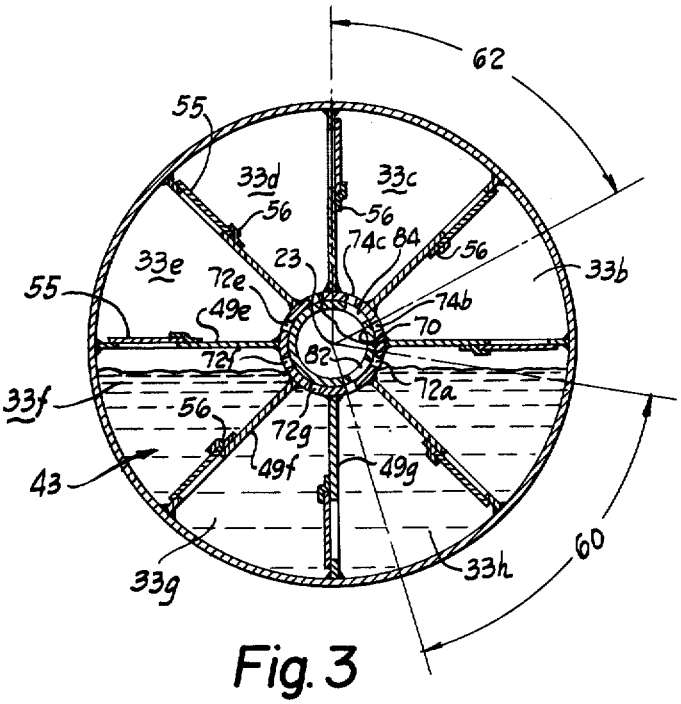
FIG. 3 is a cross-sectional view of part of the motor of FIG. 2.

A power generation system 10 embodying the present invention is schematically illustrated by FIG. 1 of the drawings. The system 10 includes a fluid motor 12 for driving an electric power generator 13 from a source of low pressure motive fluid.

Any suitable source of low pressure fluid can be used with the motor 12 and for the purpose of illustration a source of low pressure air produced by tidal action is disclosed. The pressure source is formed by a bell structure 15 defining a head space 16 in which a volume of air is trapped above the level of sea water in the bell structure. The head space 16 communicates with the motor 12 and the atmosphere via motive gas supply lines 18, 19. When tidal forces cause the bell water level to rise, the air pressure in the head space 16 rises above atmospheric pressure providing a source of motive gas which flows to the motor via the line 18 and is exhausted to atmosphere through the line 19. When tidal forces cause the bell water level to drop the pressure in the head space is reduced to a sub-atmospheric level permitting the motor to be operated by a differential pressure induced flow of atmospheric air through the line 19, the motor 12 and to the head space via the line 18.

The motor 12 includes a rotor 21 which rotates about a horizontal axis 23 defined by an output shaft structure 25 which is fixed to and forms part of the rotor. The rotor and shaft assembly are rotatably supported by a supporting base structure 26, and a mechanical linkage 27, preferably a gear train, connects the output shaft structure 25 to the generator 13.

In the embodiment illustrated by FIG. 1 the motor has an intake line 28 and an exhaust line 30 which are communicated to a four-way reversing valve 31 so that the intake and exhaust lines 28, 30 can be alternately connected to the supply line 18 or the exhaust line 19. When the tide is rising the valve 31 is positioned as illustrated with the intake line 28 communicating to the line 18 and the exhaust line 30 communicating to atmosphere via the line 19. When the tide is falling the valve 31 is positioned to connect the intake line 28 to atmosphere and the exhaust line 30 to the line 18.

As noted previously the motor 12 can also be utilized with various sources of low pressure motive gases of the sort which might otherwise be exhausted to atmosphere. The motive fluid could likewise be in the form of low pressure steam which has exited the turbine in a power generation cycle. In such environments it should be appreciated that the reversing valve 31 is not required.

The motor is governed by a control valve 32 in the intake line 28. The valve 32 is closed to prevent the motor from operating and can be adjusted in its opened position to control the output power from the motor as desired. The valve 32 may be of any suitable or conventional type and is not illustrated in detail.

Referring now to FIG. 2, the fluid motor 12 comprises a rotor 21 which is formed by a continuous cylindrical outer wall **21*a* and opposite end walls 21*b*, 21*c* which extend to the output shaft 25 so that a closed working volume 33 is defined within the rotor. The ends of the output shaft 25 extend from the rotor end walls and are supported for rotation by conventional bearings 34 (only one of which is shown) on the base structure 26**.

The rotor working volume 33 is divided into eight segmentally shaped circumferentially arranged chambers **33*a*–33*h* (see FIGS. 3, 4 and 6), by eight vane-like walls 49*a*–*h* which are equiangularly disposed about and fixedly attached to the shaft 25. The vanes 49 each extend radially from the shaft 25 to the cylindrical wall 21*a* and axially of the shaft 25 between the opposite rotor end walls 21*b*, 21*c*. The vanes 49** are fixedly attached in fluid tight engagement with the rotor walls and the shaft (for example by welding).

The vane walls **49*a*–*h* are provided with valve assemblies 51*a*–*h*, respectively, which enable one-way fluid flow from one rotor chamber to an adjacent chamber. Each valve assembly 51 comprises a generally rectangular valve port 53 defining a relatively large area flow passage in its respective vane wall 49 and a valving member 55 which is shaped to conform to the port. All of the valving members 55 are mounted to similar sides of their respective vane walls 49 and each is shiftable between a blocking, or flow preventing, position in which the valving member is seated on and blocks flow through its associated port, and an open position. The valving members 55 are biased to their blocking positions and, in the illustrated embodiment of the invention, are hinged to their respective vane walls 49 by resiliently flexible hinging members 56** which serve to lightly bias the valving members toward their blocking positions.

Two valve assemblies thus communicate with each chamber **33*a*–33*h***; one valve assembly opening into each chamber and the other valve assembly opening away from the chamber. An increase in the fluid pressure in any given chamber tends to close the valve assembly which opens into the chamber (or if the valve assembly is closed to maintain it closed), while causing the other valve assembly to open away from the chamber permitting fluid flow into the next adjacent chamber.

The working volume 33 is approximately half-filled with a suitable working fluid 43, such as water, which is substantially denser than the air forming the low pressure motive fluid. When the control valve 32 is closed no motive fluid is supplied to the rotor and the working fluid 43 is in an "at rest" condition, shown by FIG. 3, in which it occupies the rotor chambers **33*a* and 33*f*–*h* disposed in the lower half of the working volume. In this "at rest" condition the rotor remains stationary and the center of gravity of the working fluid 43 is vertically aligned with and below the axis 23**.

The control valve 32 is opened to introduce motive fluid into the working volume 33. In the preferred and illustrated embodiment of the invention motive fluid intake structure is provided for introducing motive fluid into successive rotor chambers disposed within an angular range indicated by the reference character 60 (see FIGS. 3, 4 and 6) relative to the axis 23. Referring to FIG. 3, when the motive fluid is directed into the working volume (via the chamber 33*a*) the motive fluid acts to displace the working fluid from its "at rest condition" so that the working fluid is driven from the chamber 33*a* and forms, in effect, a column of liquid on the opposite side of the rotor axis 23. The motive fluid reacts between the liquid column and the leading wall portion of the chamber 33*a* so that the rotor is driven counterclockwise, as viewed in FIG. 3, by the motive fluid and the working fluid pressure forces. In effect, the motive fluid maintains the working fluid column elevated and in so doing drives the rotor through the working fluid.

Figure 4:
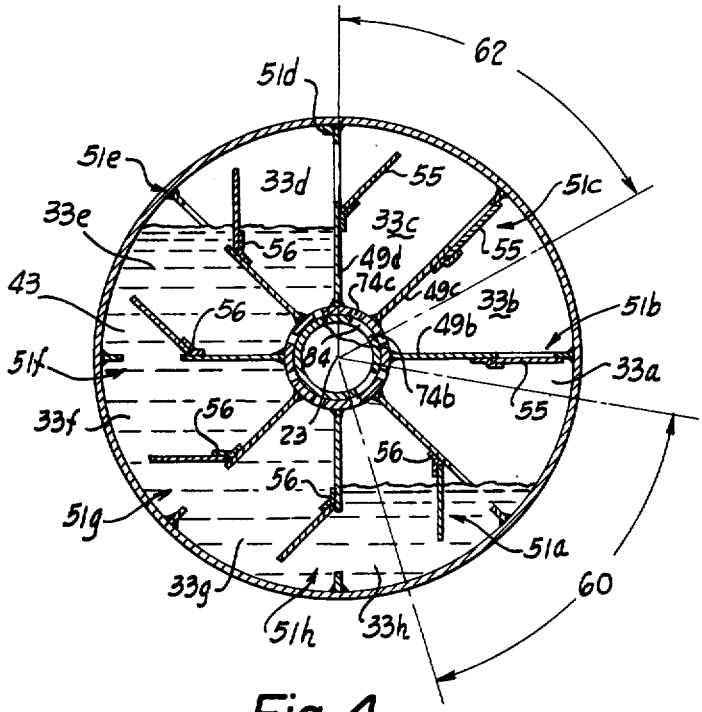
FIG. 4 is a view similar to that of FIG. 3 with parts shown in different operating position.

Exhaust structure communicates with the working volume through an angular range indicated by the reference character 62 so that as the rotor is rotated the working fluid and the rotor coact to direct motive fluid from the working chamber via the exhaust structure. FIG. 4 illustrates the rotor in a dynamic condition. As illustrated by FIG. 4 intake air is introduced into the chamber 33*a* with the motive fluid pressure and flow characteristics being such that the working fluid is displaced completely from the chamber 33*a* and substantially from the adjacent chamber 33*h* via the valve assemblies 51*a*, 51*h*.

The chamber 33*b* is cut off from communication from both the intake and exhaust structures and, as shown by FIG. 4, both the valve assemblies 33*b*, 33*c* are closed because the pressure in the chamber 33*a* tends to be greater than that in the chamber 33*b* which closes the valve 51*b*, and the pressure in the chamber 33*b* is greater than the exhaust pressure which maintains the valve assembly 51*c* closed. As soon as the chamber 33*b* sweeps into the angular range 62 the motive fluid is exhausted from the chamber 33*b* and the valve assembly 51*c* opens.

The valve assemblies 51*d*–51*g* are opened as a result of the flow of working fluid through them and the exhaust structure assures that the pressure in the chamber 33*c* is sufficiently low that motive fluid can flow through the valve assembly 51*d* to exhaust as the rotor rotates counterclockwise. The large flow areas of the valves minimize frictional losses due to flow restrictions and because the working fluid and rotor do not create substantial friction when the rotor moves, the motor tends to be relatively efficient.

The valve assemblies 51*a*–51*h* can be constructed with actuators for opening and closing the valving members 55. For example, the valving members can be provided with float structures which maintain the valve assemblies open when submerged in the working fluid and closed when the valve assemblies are out of the working fluid. Alternatively, the valving members can be associated with link arms extending through the rotor end walls to a stationary cam and a cam follower movable with the link arms and rotor. The valving members are articulated between their open and closed depending on the rotor position relative to the cam. Still another alternative is to attach electric or pneumatically powered actuators to the valving members.

In accordance with a preferred embodiment of the invention the intake and exhaust structure is formed integrally with the output shaft and enables efficient communication to and from the working volume 33 without requiring end face or vane tip seals in the rotor construction. Referring to the drawings the intake and exhaust structure is formed by the rotor shaft 25 and an internal sleeve-like valving member 70 which is supported by and coacts with the shaft 25 to control the intake and exhaust of the motive fluid.

As noted previously, the shaft 25 is a tubular cylindrical member and the shaft defines a series of radially spaced apart motive fluid intake ports 72*a*–72*h* each opening into a respective chamber 33*a*–33*h* and a series of corresponding exhaust ports 74*a*–74*h* (of which only the ports 74*b*, 74*c* are illustrated) each opening into a respective chamber 33*a*–33*h*. The ports 72, 74 are elongated and generally rectangular with the ports of each pair axially spaced apart within their rotor chamber. The area of each port is maximized to minimize restrictions to motive fluid flow. The internal periphery of the shaft 25 is preferably a smooth cylindrical bore which extends continuously through the shaft 25. The ports 72, 74 extend through the wall of the shaft 25 and open into the bore.

The valving member 70 is formed by a hollow cylindrical member which is stationarily supported in the rotatable shaft 25 between the intake and exhaust lines 28, 30. The outer periphery of the valving member closely conforms to the bore through the shaft 25 so that the shaft can rotate around the valving member without appreciable friction while maintaining an effectively gas-tight seal between the valving member exterior and the shaft bore.

Figure 6:
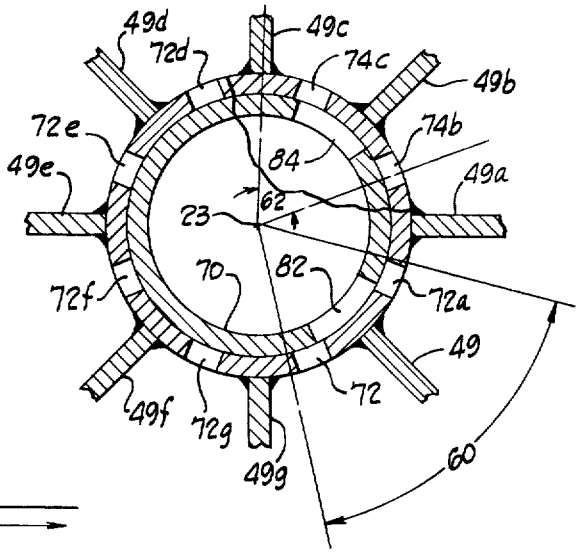
FIG. 6 is an enlarged fragmentary view of part of the motor illustrated by FIG. 3.

Referring to FIGS. 5 and 6 the valving member 70 defines circumferentially offset axially spaced motive fluid intake and exhaust ports 82, 84, respectively, which conform in length to the shaft ports 72, 74 and are sufficiently wide to bridge the closed space between adjacent shaft ports. The intake port 82 is axially aligned with the shaft intake ports 72*a*–72*h* so that when the shaft 25 rotates the ports 72*a*–72*h* are sequentially moved past the intake port 82 to enable motive fluid to flow into the working volume 33. As each respective shaft intake port moves through the angular range indicated by the reference character 60 (FIGS. 3 and 4) the associated working volume chamber receives a flow of the motive fluid.

The valving member exhaust port 84 is positioned in axial alignment with the shaft exhaust ports 74*a*–74*h* and when the shaft rotates the shaft exhaust ports sequentially move through the angular range 62 enabling exhaust of the motive fluid from the respective working volume chambers.

The valving member intake and exhaust ports are isolated from each other by a bulkhead 86 disposed within the tubular valving member between the ports. The bulkhead 86 is preferably a plug-like member which may be welded in the valving member bore. The opposite ends of the valving member are preferably formed by threaded nipple sections 87, 88 to which fittings associated with the intake and exhaust lines 28, 30 are attached.

As noted previously, the clearance between the shaft bore and the valving member is quite small so that motive fluid flow from the valving member intake port 82 to the exhaust port 84 or to atmosphere at either end of the shaft is substantially avoided. The relatively small differential pressures between the intake and exhaust further reduces any tendency for leakage to occur between these ports along the juncture of the valving member and the shaft.

Leakage of working fluid from the volume 33 can occur in small quantities by passing through the exhaust ports. Referring to FIG. 4 it can be appreciated that if working fluid were splashed into the chamber 33*c* from the chamber 33*d* the splashed fluid would gravitate to the exhaust ports. Likewise any residual working fluid in the chamber 33*c* will tend to run along the chamber walls into the exhaust ports.

The working fluid leakage is of relatively small volume and in the preferred embodiment of the invention a make-up system 90 is employed to return working fluid to the working volume. The make-up system is schematically shown by FIG. 1 and comprises an accumulator tank 92 which fills with liquid from the exhaust line 30 via a line 93 and a pump 94 for pumping the motive fluid from the tank 92 into the intake line 28 via a line 95. The amount of working fluid leakage is relatively small and therefore the pump 94 need only be operated periodically to empty the tank 92. The pump operation can be controlled by any suitable or conventional level sensing arrangements to direct the accumulated working fluid back into the rotor via the line 28 and the intake ports.

Figure 7:
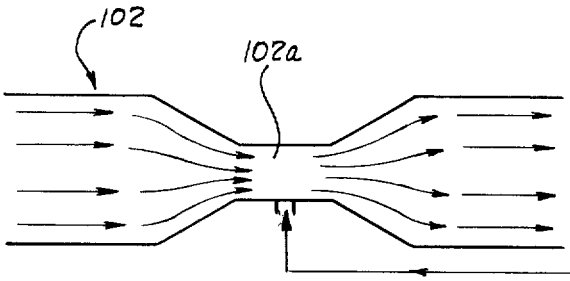
FIG. 7 is a perspective view of a modified motor embodying the invention with portions shown schematically.
Figure 7:
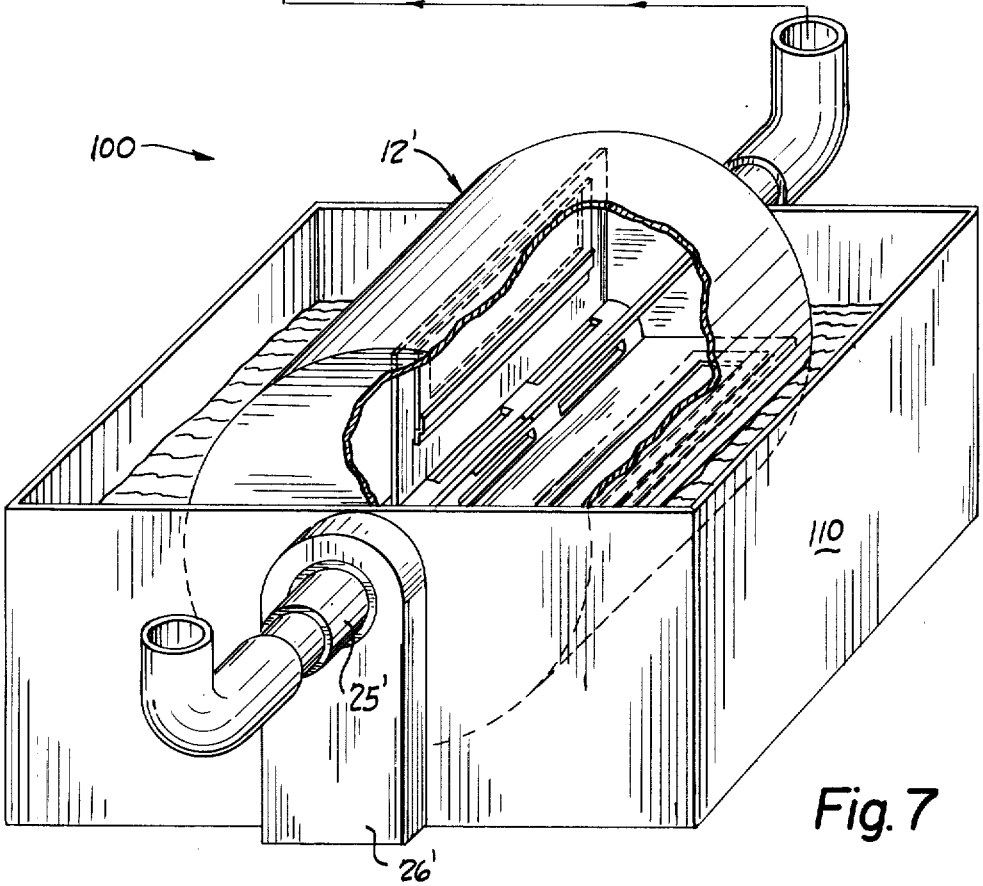

FIG. 7 illustrates part of a modified power generation system 100 embodying the invention. The system 100 includes a large scale venturi structure 102 (illustrated schematically) which is aligned in the direction of prevailing winds. Wind passing through the venturi 102 is accelerated so that subatmospheric pressure exists at the venturi throat 102*a*. The venturi throat communicates to a fluid motor 12' which is identical to the motor 12 described in reference to FIGS. 1–6 except that the motor 12' is of considerably larger size than the motor 12. A pressure differential is established across the motor 12' between atmospheric air pressure and the venturi throat pressure so that the motor 12' is driven by air flowing through it, as described previously.

In the system illustrated by FIG. 7 the pressure differential across the motor 12' is generally sufficiently small that the motor must be relatively large in order to produce appreciable amounts of power. When a large size motor is employed the weight of the rotor tends to be quite large due in large part to the amount of working fluid contained by the rotor.

In order to alleviate the bending load on the rotor shaft 25' the rotor is disposed in a tank 110 containing water or some other dense liquid. The liquid level in the tank is maintained about half way up the rotor so that the tank liquid provides buoyant forces acting on the rotor to reduce the rotor shaft load. The shaft supporting bearings are located outside of the tank as is the output gearing from the rotor shaft to the generator (not shown) so that the tank 110 and bouying liquid do not interfere with the operation of the system.

While two embodiments of the invention are illustrated and described in detail the invention is not to be considered limited to the precise constructions disclosed. Various adaptations, modifications and uses of the invention may occur to those skilled in the art to which it pertains and the intention is to cover all such adaptations, modifications and uses which come within the spirit or scope of the appended claims.

What is claimed is:

1. A fluid operated motor, comprising:

(a) a rotor mounted for rotation about a generally horizontally extending axis;

(b) said rotor defining an internal working volume comprised of a plurality of chambers located circumferentially about and radially from said axis;

(c) first valve means enabling one way fluid communication between said chambers;

(d) a working fluid disposed in said working volume, said working fluid occupying chambers of said working volume located below said axis when said rotor is at rest;

(e) intake means, including second valve means, for communicating motive fluid to said working volume, said motive fluid displacing said working fluid from at least one of said chambers via said valve means to impart torque to the rotor, said working fluid having a relatively higher density than said motive fluid; and, (f) exhaust means, including third valve means, communicable with said working volume for exhausting motive fluid from said rotor.

2. The motor claimed in claim 1 wherein said rotor is defined by a generally cylindrical drum-like member supported by an output shaft extending along said axis, said drum-like member defining an outer peripheral wall which forms a wall of said chambers.

3. The motor claimed in claim 2 further including a body of liquid in which said rotor is at least partly immersed, said liquid providing bouyant forces acting on said rotor.

4. The motor claimed in claim 1 further including a tubular output shaft attached to said rotor and supported for rotation on said axis, said second and third valve means comprising intake and exhaust ports defined by said shaft and communicable with said respective chambers and a valving member disposed within said output shaft and selectively communicating with individual ones of said shaft ports.

5. A fluid motor comprising:

(a) a rotor supported for rotation about a generally horizontal axis;

(b) said rotor having a working volume defined by a plurality of chambers each having a leading wall portion and a trailing wall portion, said wall portions circumferentially spaced apart relative to the axis with said leading wall portion spaced from said trailing wall portion in the direction of rotation of said rotor;

(c) means, including first valve means, defining a relatively large area flow passage extending from the trailing wall portion of each chamber to a succeeding chamber to enable fluid flow between said chambers in a direction opposite to the direction of rotation of the rotor;

(d) a working fluid partially occupying said working volume;

(e) intake means, including second valve means, for introducing a motive fluid into said working volume, said intake means directing said motive fluid into successive chambers which are disposed within a predetermined angular range relative to said axis, said motive fluid substantially confined in said chambers in said angular range and displacing said working fluid from said chambers through said respective flow passages, said working fluid having a greater density than said motive fluid; and, (f) exhaust means, including third valve means, communicating with successive chambers disposed within a second angular range relative to said axis for enabling motive fluid to flow from said chambers.

6. The motor claimed in claim 5 wherein said first valve means comprises a valving member associated with each chamber which is effective to block fluid flow from its respective chamber in the direction of rotor rotation.

7. The motor claimed in claim 5 wherein said rotor comprises a drum-like member, and further comprising a supporting shaft rotatable about said axis, and a plurality of vane-like members extending radially from said shaft and fixed to said rotor and said shaft, said chambers defined between successive vane-like members.

8. The motor claimed in claim 7 wherein said first valve means comprises a port formed in each of said vane-like members and a valving member associated with said port for blocking said port to block fluid flow in the direction of rotation of said rotor.

9. The motor claimed in claim 8 further including means for biasing said valving member toward blocking said port at least when the associated chamber is in said first angular range.

10. The motor claimed in claim 5 wherein said intake and exhaust means comprise a tubular output shaft supporting said rotor for rotation about said axis and said second and third valve means comprise a valving member supported within said output shaft for enabling motive fluid intake and exhaust in said respective angular ranges.

11. The motor claimed in claim 10 wherein said output shaft defines a series of intake ports each communicating with a respective chamber and a series of exhaust ports each communicating with a respective chamber, said valving member defining angularly displaced intake and exhaust ports communicating with respective shaft intake and exhaust ports.

12. The motor claimed in claim 5 further comprising output shaft means supporting said rotor for rotation about said axis and structure supporting a body of liquid for receiving said rotor, said liquid exerting bouyant forces on said rotor to reduce the loading on said output shaft means.

13. A fluid motor comprising:

(a) a rotor extending along a rotation axis and defined in part by a series of axially extending circumferentially spaced apart fixed volume fluid receiving chambers with a working fluid in at least some of said chambers;

(b) tubular shaft structure supporting said rotor for rotation about said axis, said shaft structure rotating with said rotor and defining axially elongated fluid ports directly communicating, respectively, with said chambers; and (c) intake valving means for communicating selected ones of said fluid receiving chambers to a source of motive fluid which is less dense than said working fluid, said valving means comprising a valving member supported within said shaft structure and fixed against rotation with said shaft structure, said valving member defining an axially extending motive fluid passage having a portion alignable with successive ones of said fluid ports as said shaft structure rotates so that successive rotor chambers are communicated with said fluid source;

(d) valve means enabling one-way fluid communication between said chambers with said motive fluid displacing said working fluid from one chamber via said valve means to another chamber; and, (e) exhaust valving means for exhausting motive fluid from said chambers.

14. The motor claimed in claim 13 wherein said exhaust valving means comprises a plurality of exhaust ports formed in said shaft structure, each exhaust port communicating with a respective chamber, said valving means defining a second passage having portions alignable with successive ones of said exhaust ports to enable the exhaust of motive fluid from said chambers.

15. The motor claimed in claim 1 wherein said exhaust means communicates with the throat section of a venturi structure through which wind passes.

16. The motor claimed in claim 5 wherein said exhaust means communicates with the throat section of a venturi structure through which wind passes and said intake means communicates with atmospheric air.

17. A fluid operated motor, comprising:

(a) a rotor mounted for rotation about an axis;

(b) said rotor defining an internal working volume comprised of a plurality of chambers located circumferentially about and radially from said axis;

(c) first valve means enabling one way fluid communication between said chambers;

(d) a working fluid disposed in said working volume, said working fluid occupying chambers in said working volume;

(e) intake means, including second valve means, directing motive fluid into said working volume and displacing working fluid from at least a chamber of said working volume via said first valve means, said motive fluid having a lower density than said working fluid; and, (f) exhaust means, including third valve means, for directing motive fluid from said rotor.

18. A fluid operated motor comprising:

(a) a rotor mounted for rotation about a generally horizontally extending axis, the path of said rotor being herein defined in terms of a 360 degree circuit with its zero reference angle at bottom dead center and increasing in the direction of rotor rotation;

(b) said rotor defining an internal working volume comprised of a plurality of chambers located circumferentially about and radially from said axis;

(c) first valve means enabling one way fluid communication between said chambers;

(d) a relatively high density working fluid disposed in said working volume, said working fluid occupying chambers of said working volume located below said axis when said rotor is at rest;

(e) intake means for communicating motive fluid to said working volume, said intake means including second valve means operative to admit relatively low density motive fluid to each working chamber as it passes through a portion of its arcuate path between zero degrees and 180 degrees; and, (f) exhaust means including third valve means operative to exhaust the motive fluid from each working chamber as it passes through some portion of its arcuate path between 90 degrees and 360 degrees, said portions of the arcuate path along which said motive fluid is admitted and exhausted being spaced angularly apart.

* * * * *